US007996942B2

(12) United States Patent
Fleischer et al.

(10) Patent No.: US 7,996,942 B2
(45) Date of Patent: Aug. 16, 2011

(54) ROTATING GANGWAY SUPPORT PLATFORM

(75) Inventors: Corey A. Fleischer, Columbia, MD (US); Matthew Kapelanczyk, Baltimore, MD (US); Greg W. Klein, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 95 days.

(21) Appl. No.: 12/491,969

(22) Filed: Jun. 25, 2009

(65) Prior Publication Data

US 2010/0199444 A1 Aug. 12, 2010

Related U.S. Application Data

(63) Continuation-in-part of application No. 12/370,261, filed on Feb. 12, 2009.

(51) Int. Cl.
*E01D 1/00* (2006.01)

(52) U.S. Cl. ..... 14/69.5; 182/48; 114/362

(58) Field of Classification Search ..... 14/69.5–71.5; 182/48

See application file for complete search history.

(56) References Cited

U.S. PATENT DOCUMENTS

| | | | |
|---|---|---|---|
| 2,641,785 | A | 6/1953 | Pitts et al. |
| 2,803,841 | A | 8/1957 | Wellens |
| 4,011,615 | A | 3/1977 | Maxson et al. |
| 4,083,072 | A | 4/1978 | Ryan |
| 4,133,283 | A | 1/1979 | Ryan |
| 4,228,582 | A | 10/1980 | Arai |
| 4,366,591 | A | 1/1983 | Zimmerman |
| 5,135,076 | A | 8/1992 | Su |
| 6,347,424 | B1 | 2/2002 | Vatne |
| 6,955,134 | B2 | 10/2005 | Prins |
| 7,331,302 | B2 | 2/2008 | Secretan et al. |
| 2010/0032543 | A1 | 2/2010 | Van Der Tempel et al. |

FOREIGN PATENT DOCUMENTS

| | | | |
|---|---|---|---|
| FR | 2465640 | | 3/1981 |
| FR | 2586641 | B2 | 3/1987 |
| GB | 2246992 | A | 2/1992 |
| NL | 7203341 | A | 9/1973 |
| SU | 610718 | A1 | 6/1978 |

OTHER PUBLICATIONS

Raffaelli, Leonardo, "PCT Application No. PCT/US2009/033952 International Search Report Apr. 8, 2010", , Publisher: PCT, Published in: PCT.

(Continued)

*Primary Examiner* — Raymond W Addie
(74) *Attorney, Agent, or Firm* — DeMont & Breyer, LLC

(57) ABSTRACT

A crew transfer system for transferring personnel from a vessel to a stationary platform, such as an oil rig, is disclosed. In the illustrative embodiment, the system includes a ramp that is coupled to the vessel and an interface that is attached to the stationary platform. The ramp is coupled to the vessel in such a way as to permit one translational and three rotational degrees of freedom at the vessel-end of the ramp. The ramp is coupled to the interface in such a way as to permit no translational and at least one rotational degree-of-freedom at the rig-end of the ramp with respect to the interface. The interface is rotatably coupled to the stationary platform in such a way as to permit a rotation of the interface about the yaw axis. Permitted rotation of the interface enables a range of acceptable angles of orientation between the vessel and the platform.

20 Claims, 5 Drawing Sheets

OTHER PUBLICATIONS

Addie, Raymond W., "U.S. Appl. No. 12/370,261 Office Action Aug. 24, 2010", , Publisher: USPTO, Published in: US.
Addie, Raymond W., "U.S. Appl. No. 12/550,003 Office Action Oct. 6, 2010", , Publisher: USPTO, Published in: US.
Raffaelli, Leonardo, "PCT Application No. PCT/US2009/033952 Aug. 13, 2010", , Publisher: PCT, Published in: PCT.
Deschanel, Sylvain, "AU Application No. 2009214641 Office Action Feb. 16, 2011", , Publisher: IPA, Published in: AU.
Addie, Raymond W., "U.S. Appl. No. 12/370,261 Office Action Dec. 30, 2010", , Publisher: USPTO, Published in: US.

ROTATING GANGWAY SUPPORT PLATFORM

CROSS REFERENCE TO RELATED APPLICATIONS

This case is a continuation-in-part of co-pending U.S. patent application Ser. No. 12/370,261 filed 12 Feb. 2009, which is incorporated by reference herein.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to a system suitable for transporting personnel between a sea-faring vessel and a stationary or quasi-stationary platform, such as an oil rig, in high sea states.

BACKGROUND OF THE INVENTION

Safely and efficiently transporting personnel to oil platforms in the open ocean is a formidable challenge. In particular, wave heights of two to three meters and thirty-knot winds are not uncommon. In these conditions, transfer vessels experience pronounced heaving, pitching, and rolling motions, especially when they are at zero forward speed.

Traditionally, crews have been transferred to an oil rig via a crane-and-basket method or using a basket that is deployed from a helicopter. In the former method, personnel being transferred from a vessel step into or hang on to a basket that is suspended from a rig-mounted crane. The crane then hoists the basket and swings it over to the rig. In the latter technique, personnel are lowered from a helicopter on to the rig via a basket.

Used for the decades, both of these personnel-transfer methods involve certain risks. The usual accidents include lateral impacts, falling, hard landings, and water immersion.

Furthermore, the crane-and-basket method relies on the availability of the platform crane operator. A delay caused by the non-availability of a crane operator when needed results in down-time costs as well as an increase in the incidence of seasickness due to personnel spending an extended period time on a stationary but heaving/pitching/rolling transport vessel.

More recently, a gangway technique has been used wherein the free end of a ramp that is disposed on the oil rig is rotated toward and landed on a crew-transfer vessel. This technique is only suitable for use in relatively low sea states (e.g., sea state 2, etc.) since relatively higher sea states can cause substantial movement of the ramp. Such movement can present a safety risk to personnel that are using the ramp to transfer to an oil rig.

SUMMARY OF THE INVENTION

The present invention provides a crew transfer system that avoids some of the drawbacks and costs of the prior art. Among other advantages, the crew transfer system is useable to safely transfer personnel from a transfer vessel to stationary or quasi-stationary platform, such as an oil rig, in high sea states.

A crew transfer system in accordance with the illustrative embodiment of the present invention comprises a ramp, a first coupling, a second coupling, and an interface disposed on a stationary platform (e.g., oil rig, etc.), wherein the interface comprises a third coupling. The ramp is configured so that persons wishing to transfer between the vessel to the rig can simply walk across the ramp, even in high sea states.

In use, a first end of the ramp is coupled, for translation and rotation, to the transport vessel via the first coupling. The first coupling comprises a "first mechanism" that imparts three rotational degrees-of-freedom to the first end of the ramp. The three rotational degrees-of-freedom permit the ramp to (1) pitch about a pitch axis of the ramp; (2) roll about a roll axis of the ramp; and (3) yaw about a yaw axis of the ramp. In the illustrative embodiment, the first mechanism includes a bearing and several pins that provide these three rotational degrees-of-freedom.

In the illustrative embodiment, the system further comprises a guide that is disposed on the transport vessel. In the illustrative embodiment, the guide is implemented as two rails. The first coupling further comprises a movable platform, wherein the first mechanism is disposed on the movable platform, and wherein the movable platform movably couples to the rails to provide the one translational degree of freedom to the first end of the ramp. In other words, the first end of the ramp is free to move along the rails towards the bow or stern of the transfer vessel.

The translational degree-of-freedom imparted by the moveable platform (and guide) prevents the first end of the ramp from moving laterally across the transfer vessel (i.e., prevents the end of the ramp from moving in the manner of a windshield wiper). The only translational motion of the first end of the ramp that is permitted by the system is along an axis that runs from bow to stern of the transfer vessel. In other words, the ramp is only permitted to move back and forth (i.e., a reciprocating movement) due to guide.

The second end of the ramp is rotationally coupled to the interface via the second coupling. The second coupling comprises a second mechanism that imparts a rotational degree-of-freedom about a pitch axis of the ramp to the second end of the ramp.

In the illustrative embodiment, the system further comprises an interface that includes a third coupling that enables rotation of the interface with respect to the stationary platform. The third coupling movably couples the interface to a fixture (e.g., deployable staircase, etc.) that depend from the oil rig. In the illustrative embodiment, the third coupling is implemented as a bearing oriented to rotate about the yaw axis of the fixture. As a result, the interface can rotate to facilitate the receipt of the transfer vessel when its orientation is within a broad range of angles with respect to the oil rig.

An embodiment of the present invention is a system for transferring personnel or material from a transport vessel to a stationary platform at sea, wherein the system comprises: a ramp, wherein in use, a first end of the ramp is movably coupled to the transport vessel and a second end of the ramp is movably coupled to an interface; a first coupling, wherein the first coupling movably couples together the first end of the ramp and the transport vessel, and wherein the first coupling provides three rotational degrees-of-freedom and no more than one translational degree-of-freedom to the first end of the ramp; a second coupling, wherein the second coupling movably couples together the second end of the ramp and the interface, and wherein the second coupling provides one rotational degree-of-freedom to the second end of the ramp; the interface, wherein the interface is rotatably coupled to the stationary platform; and a third coupling, wherein the third coupling movably couples together the interface and the stationary platform, and wherein the third coupling provides one rotational degree-of-freedom to the interface, and further wherein the rotational degree-of-freedom of the interface is substantially orthogonal to the rotational degree-of-freedom of the second end of the ramp.

DETAILED DESCRIPTION

This patent application is a continuation-in-part of U.S. patent application Ser. No. 12/370,261 filed 12 Feb. 2009 (the "parent application"), which described a crew transfer system that could be used to couple a transfer vessel to a stationary or quasi-stationary platform, located in a large body of water, to effect the transfer of personnel or cargo.

The present invention augments the disclosure of the parent application by disclosing an interface that enables the transfer vessel to be more easily coupled to the platform. Specifically, the present invention discloses an "interface" that is rotatably coupled to the platform. The interface enables a wider range of acceptable coupling orientations between the transfer vessel and the platform than can be accommodated with embodiments disclosed in the parent application.

In an illustrative embodiment, the crew transfer system is used to transfer personnel from a transfer vessel to an oil rig in the open ocean. It will be understood that the present invention can be used to transfer personnel from a vessel to any stationary or quasi-stationary platform on the ocean. In conjunction with the present disclosure, those skilled in the art will be able to adapt the illustrative embodiment of the crew transfer system, as described below and depicted in the accompanying drawings, for use in coupling most transfer vessels to most stationary or quasi-stationary platforms to effect transfer of personnel.

Figure 1:
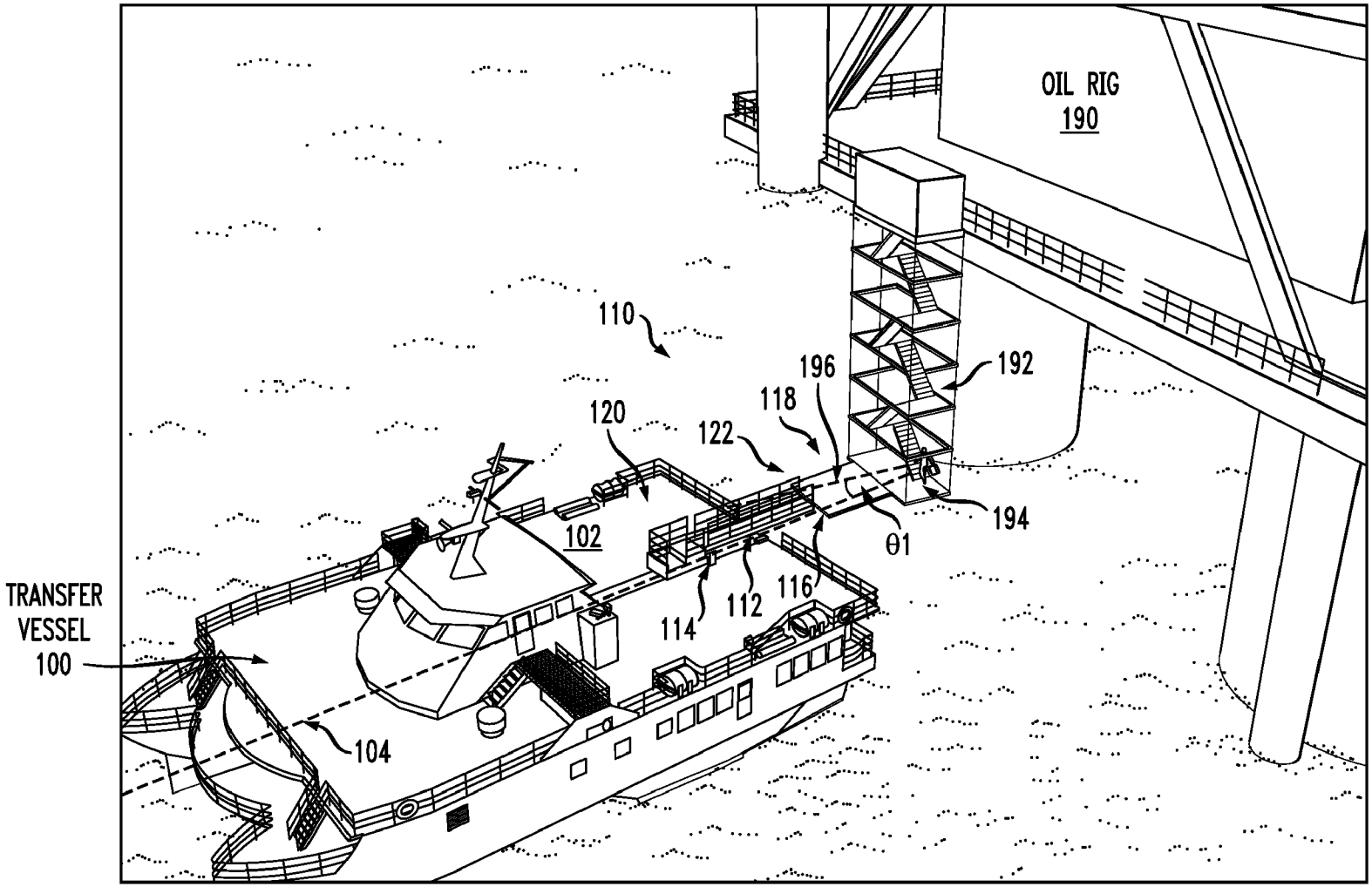
FIG. 1 depicts a crew transfer system deployed between a transfer vessel and an oil rig, in accordance with an illustrative embodiment of the present invention.

Turning now to the Figures, FIG. 1 depicts a "bridge" formed between transfer vessel 100 and oil rig 190 via a crew transfer system, generally indicated at "110," in accordance with the illustrative embodiment of the present invention. Crew transfer system 110 comprises ramp 112, coupling 114, coupling 116, and interface 118 (details of the couplings are not shown in FIG. 1).

Coupling 114 couples a "first" or "vessel" end 120 of ramp 112 to transfer vessel 100 and coupling 116 couples a "second" or "rig" end 122 of ramp 112 to interface 118. Interface 118 is coupled to oil rig 190. In the embodiment that is depicted in FIG. 1, interface 118 is attached to platform 194, which is located at the bottom of stairs 192, which depend from oil rig 190.

Coupling 114 couples vessel end 120 of ramp 112 to rails 202. Coupling 114 provides three rotational degrees-of-freedom and one translational degree-of-freedom to vessel end 120. Coupling 114 is described in detail below and with respect to FIGS. 2A, 2B, and 3.

Interface 118 is rotatably coupled to platform 194 as described below and with respect to FIGS. 5A-C.

The orientation of transfer vessel 100 is indicated by center line 104, which runs through the center of vessel 100 from bow to stern. In FIG. 1, transfer vessel 100 is shown at an orientation that is at a non-zero angle, angle θ1, with respect to reference line 196 of platform 194. Reference line 196 is orthogonal to a side of platform 194. In the parent application, values of θ1 that enable coupling of transport vessel 100 and platform 194 are very small. As discussed below, the present invention enables coupling of the vessel and platform over a much larger range for angle θ1.

Figure 2B:
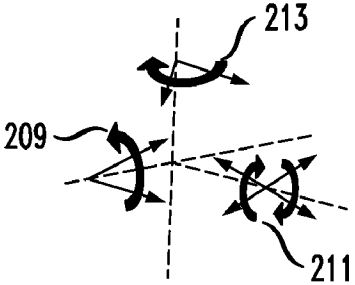
FIG. 2B depicts rotational axes of a vessel-end coupling in accordance with the illustrative embodiment of the present invention.
Figure 2A:
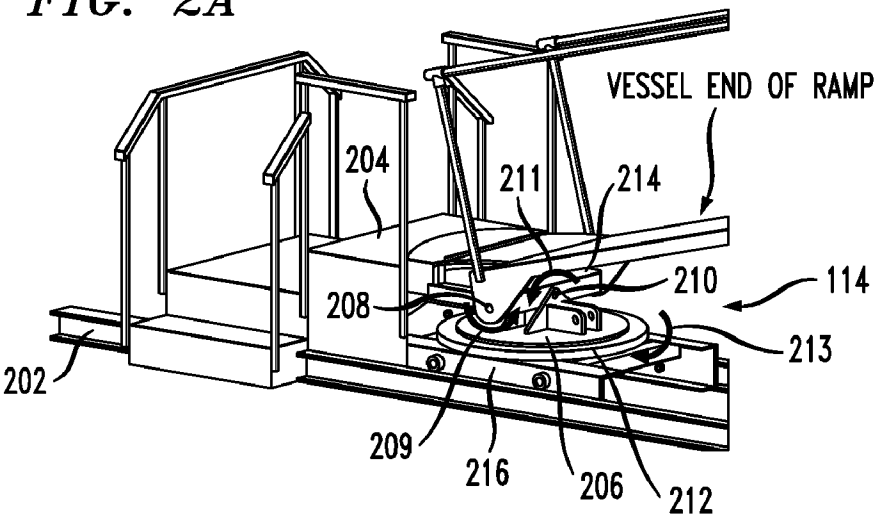
FIG. 2A depicts details of a vessel-end coupling in accordance with the illustrative embodiment of the present invention.

FIG. 2A depicts details of the vessel end 120 of ramp 112 and coupling 114 by which the ramp couples to transfer vessel 100. As depicted in FIG. 2A, coupling 114 comprises first mechanism 206 and movable platform 216.

First mechanism 206 comprises hinge pin 208, roll pin 210, and bearing 212. Roll pin 210 is disposed on bearing 212, and hinge pin 208 is disposed on member (e.g., bar, etc.) 214 that rotates about the roll pin. Referring now to FIG. 2B as well as FIG. 2A, hinge pin 208 enables vessel-end 120 of ramp 112 to pitch about pitch axis 209. Roll pin 210 enables the vessel-end 120 of ramp 112 to roll about roll axis 211. Bearing 212 enables vessel-end 120 of ramp 112 to yaw about yaw axis 213. The various pins and bearings of first mechanism 206 are arranged, as shown, to provide three rotational degrees-of-freedom to vessel-end 120 of ramp 112. Although the illustrative embodiment comprises a mechanism that includes a different assembly for providing each of three rotational degrees-of-freedom, it will be clear to one skilled in the art, after reading this specification, how to specify, make, and use alternative embodiments of the present invention wherein more than one rotational degree-of-freedom is provided by a single assembly.

In some embodiments, first mechanism 206 is arranged so that hinge pin 208 provides for up to +40 degrees of pitch (about axis 209), roll pin 210 provides for roll of up to −15 to +15 degrees (about axis 211), and bearing 212 provides for yaw of up to −40 to +40 degrees (about axis 213).

First mechanism 206 is disposed on movable platform 216. Platform/steps 204 are disposed on movable platform 216 as well. In the illustrative embodiment, movable platform 216 engages guide rails 202. In the illustrative embodiment, guide rails 202 are implemented as I-beam-like rails.

Guide rails 202 are oriented along center line 104 (See FIG. 1). In some embodiments, guide rails 202 are rigidly attached along their full length to transfer vessel 100. In some other embodiments, the guide rails are pivotably attached to the transfer vessel, wherein the attachment point is relatively closer to the bow of vessel 100.

Movable platform 216 and guide rails 202 enable vessel-end 120 to translate in a single direction; namely, along rails 202. In this manner, coupling 114 imparts three rotational degrees of freedom and one translational degree of freedom to vessel-end 120. Note that in the illustrative embodiment, platform/steps 204 translate with movable platform 216.

Figure 3:
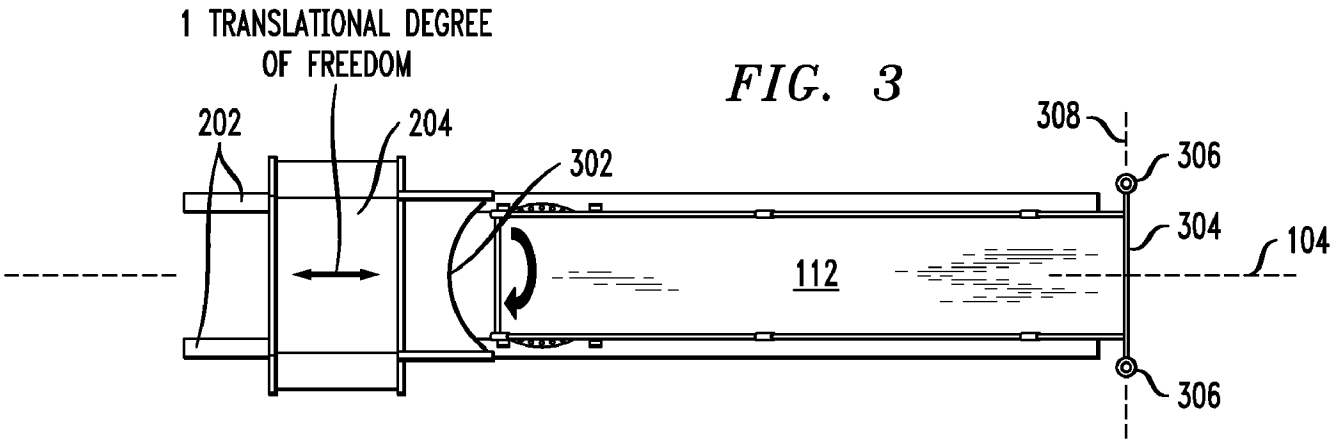
FIG. 3 depicts a top view of the vessel end of ramp 112.

FIG. 3 depicts a top view of the vessel end of ramp 112. Interface 302 between edge of platform/steps 204 and ramp 112 is curved (i.e., the respective adjacent edges of the platform/steps and the ramp are curved) to permit unfettered rotational movement (i.e. yaw) of vessel-end 120. The translational movement of the vessel-end of ramp 112 along guide rails 202 is depicted.

Crew transfer system 110 comprises guide rails 202, which are fixed to deck 102 of transport vessel. Guide rails 202 are oriented parallel to center line 104. Typically, although not necessarily, guide rails 202 are equally spaced on either side of center line 104.

At rig-end 122, ramp 112 terminates at coupling member 304 and eyelets 306. Coupling member 304 defines pitch axis 308.

Figure 4:
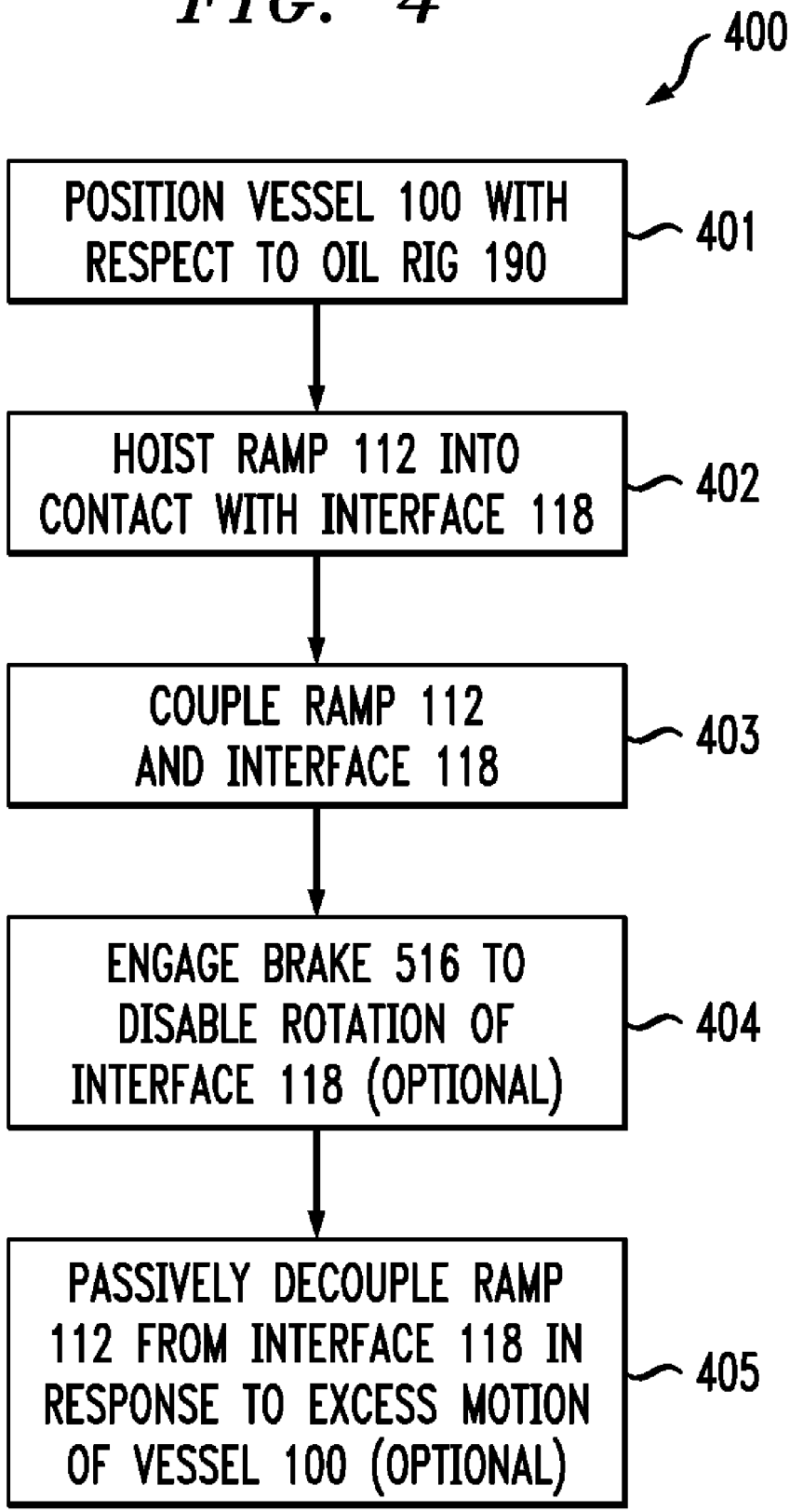
FIG. 4 depicts a method for coupling a transfer vessel and a stationary platform in accordance with the illustrative embodiment of the present invention.

FIG. 4 depicts a method for coupling a transfer vessel and a stationary platform in accordance with the illustrative embodiment of the present invention. Method 400 begins with operation 401, wherein vessel 100 is positioned with respect to oil rig 190. Method 400 is described herein with reference to FIGS. 5-6 and continuing reference to FIGS. 1-3.

Vessel 100 is positioned such that center line 104 and reference axis 196 form an angle within a range of −30 degrees to +30 degrees. This wide range of acceptable angles is enabled by the fact that interface 118 is rotatably coupled to platform 194. As a result, ramp 112 can be hoisted into a coupled position with interface 118 with vessel 100 oriented anywhere within this range of angles with respect to platform 194.

At operation 401, rig-end 122 of ramp 112 is hoisted into contact with interface 118.

Figure 5A:
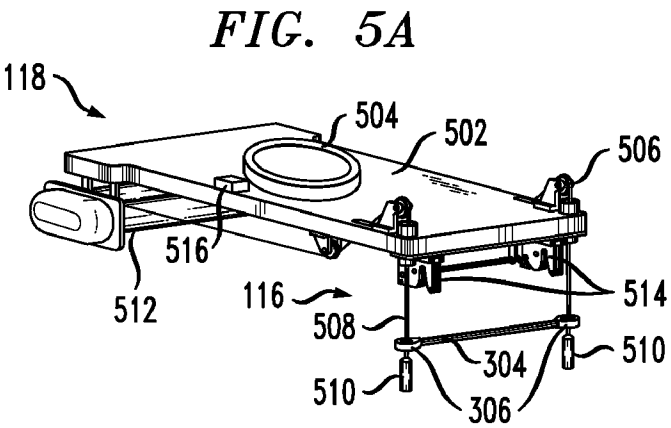
FIG. 5A depicts a perspective view of an interface in accordance with the illustrative embodiment of the present invention.

FIG. 5A depicts a perspective view of interface 118. Interface 118 comprises frame 502, coupling 504, pulleys 506, cables 508, cable ends 510, winch 512, second mechanism 514, and brake 516.

In order to hoist rig-end 122 into position with interface 118, winch 512 feeds cables 508 over pulleys 506 to drop cable ends 510 toward ramp 112. Cable ends 510 pass through and temporarily engage eyelets 306 by means of pins used to couple cable ends 510 and eyelets 306.

In some embodiments, remotely actuated breakaway pins are used to couple cable ends 510 and eyelets 306 so that ramp 112 can be decoupled from cables 508 in response to motion of vessel 100 that exceeds a predetermined damage threshold. In still some other embodiments, breakaway elements are used to couple cable ends 510 and eyelets 306. These breakaway elements can be selected with a predetermined fracture stress so that they release eyelets 306 from cable ends 510 in order to avoid damage due to motion of vessel 100 that exceeds a predetermined threshold. Such excess motion of vessel 100 with respect oil rig 190 can be caused by, for example, rogue waves, high winds, wakes from nearby vessels, and the like. The level of motion corresponding to the damage threshold is a function of application and design. One skilled in the art, after reading this specification, will be able to determine a suitable level for the damage threshold.

Once cable ends 510 and eyelets 306 are coupled, winch 512 retracts cables 508 to raise rig-end 122 to interface 118.

Figure 5B:
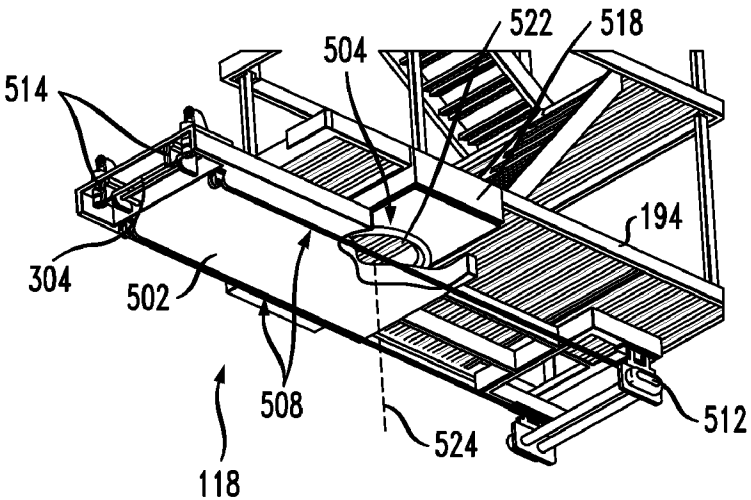
FIGS. 5B and 5C depict perspective views of the top and bottom, respectively, of interface 118 as coupled with platform 192.
Figure 5C:
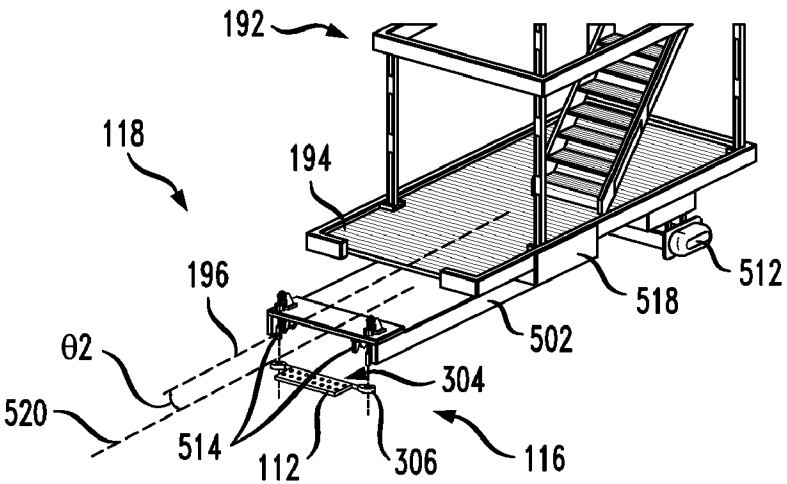

FIGS. 5B and 5C depict perspective views of the top and bottom, respectively, of interface 118 as coupled with platform 192.

Frame 502 is a structurally rigid plate that is rotatably coupled with plate 518 at coupling 504. Anchor 518 is fixed to platform 194. Coupling 504 comprises bearing 522, which enables rotation of frame 502 about yaw axis 524. The orientation of frame 502 (and, therefore, interface 118) about yaw axis 524 is designated by reference line 520. When interface 118 is in its default orientation, reference line 520 is aligned with reference line 196 of platform 194. The degree of rotation of interface 118 from its default position is denoted by angle θ2. In some embodiments, bearing 522 enables rotation of interface 118 up to ±30 degrees with respect to reference line 196.

As winch 512 raises rig end 122, a mis-orientation of vessel 100 with respect to oil rig 190 (i.e., angle θ1 as depicted in FIG. 1) induces a lateral force (through cables 508) on interface 118. Bearing 522 enables interface 118 to rotate in response to this lateral force, which increases the magnitude of angle θ2. As a result, coupling 504 enables interface 118 to accommodate a larger degree of misalignment between vessel 100 and oil rig 190.

In some embodiments, interface 118 is proactively rotated to more closely align it with vessel 100 prior to the deployment of cables 508 by winch 512.

Figure 6B:
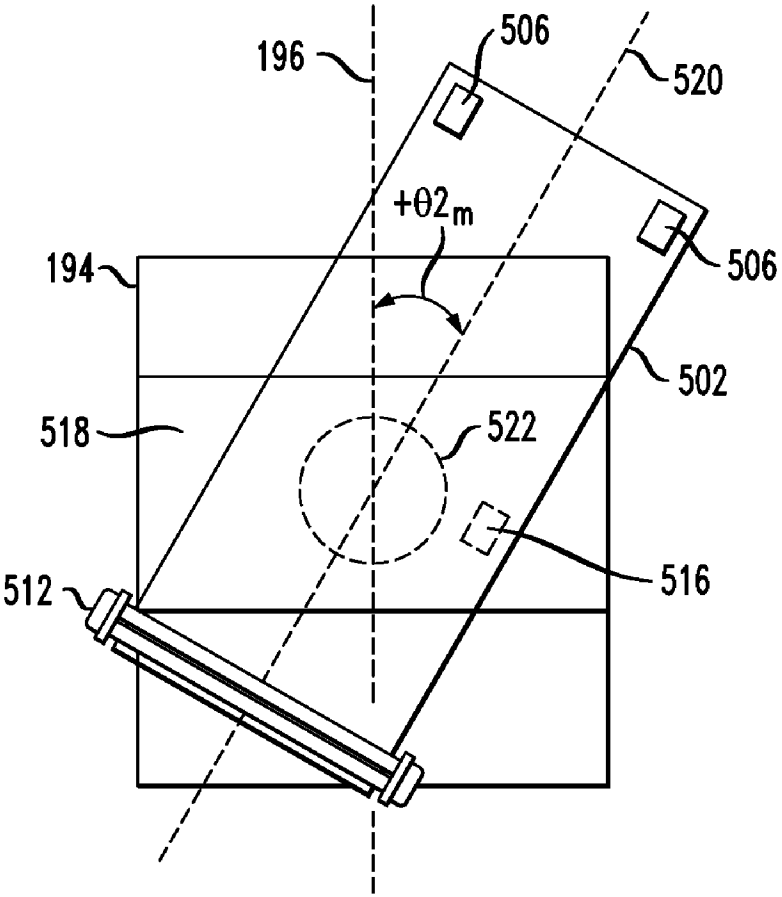
FIG. 6B depicts interface 118 rotated to its extreme positive position.
Figure 6A:
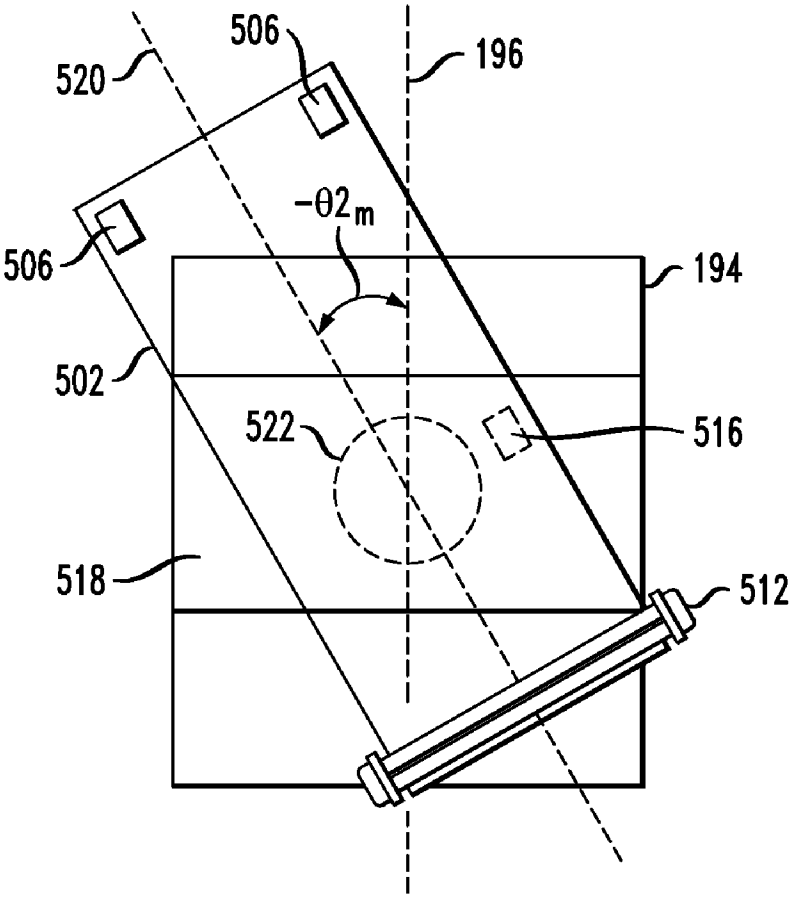
FIG. 6A depicts interface 118 rotated to its extreme negative position.

FIG. 6A depicts interface 118 rotated to its extreme negative position. At this position θ2 equals $-\theta 2_{max}$.

FIG. 6B depicts interface 118 rotated to its extreme positive position. At this position θ2 equals $+\theta 2_{max}$.

At operation 403, coupling member 304 engages second mechanism 514 and couples rig-end 122 and interface 118. As described in the parent application, second mechanism 514 enables rotation of coupling member 304 about pitch axis 308 (see FIG. 3). As a result, rig-end 122 is rotatable about pitch axis 308.

In some embodiments, the positions of second mechanism 514 and coupling member 304 are reversed such that second mechanism 514 is disposed on the ramp 112 and coupling member 304 is disposed on interface 118. Such an arrangement facilitates an ability to control the state of coupling 116 from onboard vessel 100.

At optional operation 404, brake 516 is engaged to disable rotation of interface 118 about yaw axis 524. In some cases, operation 404 is carried out once ramp 112 and interface 118 are coupled, thereby limiting further motion of rig-end 122 of ramp 112. In some cases operation 404 is conducted to lock interface 118 in its default position to await the arrival of a transfer vessel.

At optional operation 405, ramp 112 is decoupled from interface 118 in response to motion of vessel 100 that exceeds a predetermined threshold. Operation 405 mitigates risk of damage due to excessive motion of vessel 100 with respect to oil rig 190.

In order to enable operation 405, second mechanism 514 comprises failure mechanisms that are analogous to the pins for joining cable ends 510 and eyelets 306, as described above. In some embodiments, second mechanism 514 comprises passively actuated release mechanism that triggers at the predetermined threshold. In some embodiments, second mechanism 514 proactively decouples ramp 112 and interface 118 in response to a command.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for transferring personnel or material from a transport vessel to a stationary platform at sea, wherein the system comprises:

a ramp, wherein in use, a first end of the ramp is movably coupled to the transport vessel and a second end of the ramp is movably coupled to an interface;

a first coupling, wherein the first coupling movably couples together the first end of the ramp and the transport vessel, and wherein the first coupling provides three rotational degrees-of-freedom and no more than one translational degree-of-freedom to the first end of the ramp;

a second coupling, wherein the second coupling movably couples together the second end of the ramp and the interface, and wherein the second coupling provides one rotational degree-of-freedom to the second end of the ramp;

the interface, wherein the interface is rotatably coupled to the stationary platform; and a third coupling, wherein the third coupling movably couples together the interface and the stationary platform, and wherein the third coupling provides one rotational degree-of-freedom to the interface, and further wherein the rotational degree-of-freedom of the interface is substantially orthogonal to the rotational degree-of-freedom of the second end of the ramp.

2. The system of claim 1 wherein the interface is rotatably coupled to a structure that depends from the stationary platform.

3. The system of claim 1 wherein the rotational degree-of-freedom provided by the third coupling is yaw about a yaw axis of the stationary platform.

4. The system of claim 1 wherein the third coupling comprises a bearing that enables the interface to partially rotate about the yaw axis.

5. The system of claim 4 wherein the bearing permits rotation within the range of approximately +30 degrees to approximately −30 degrees relative to a reference axis at 0 degrees.

6. The system of claim 1 wherein the three rotational degrees-of-freedom imparted by the first coupling comprise pitch about a pitch axis of the ramp, roll about a roll axis of the ramp, and yaw about a yaw axis of the ramp.

7. The system of claim 6 wherein the first coupling comprises a first mechanism, and wherein the first mechanism creates the three rotational degrees-of-freedom of the first end of the ramp.

8. The system of claim 7 wherein the first coupling further comprises a movable platform, wherein the first mechanism is disposed on the movable platform, and wherein the movable platform movably couples to the transfer vessel to provide the one translational degree of freedom to the first end of the ramp.

9. The system of claim 8 further comprising guides, wherein the guides are disposed on the transport vessel and the movable platform movably couples to the guides.

10. The system of claim 1 wherein the second coupling comprises a first mechanism and a second mechanism, and wherein the first mechanism and second mechanism engage to physically couple the ramp and the interface, and further wherein the first mechanism and second mechanism collectively create the rotational degree-of-freedom of the second coupling.

11. The system of claim 10 wherein the first mechanism comprises a latch and the second mechanism comprises a coupling member, and wherein the latch captures the coupling member to engage the first mechanism and second mechanism, and further wherein the coupling member is rotatable about the roll axis of the interface when the latch and coupling member are engaged.

12. The system of claim 11 wherein the latch is fixed to the second end of the ramp.

13. The system of claim 12 wherein the second coupling further comprises a third mechanism that actuates the latch when motion of the transport vessel with respect to the stationary platform exceeds a threshold.

14. The system of claim 1 further comprising a brake, wherein the brake disables rotation of the interface with respect to the stationary platform.

15. A method for coupling a transport vessel and a stationary platform at sea, wherein the method comprises:

positioning the transport vessel with respect to the stationary platform, wherein the stationary platform comprises an interface that is movably coupled with the stationary platform at a first coupling that provides a rotational degree-of-freedom about a first axis; and coupling a first end of a ramp and the interface at a second coupling that provides a rotational degree-of-freedom about a second axis that is orthogonal to the first axis, wherein a second end of the ramp and the transport vessel are movably coupled at a third coupling that provides three rotational degrees-of-freedom and one translational degree-of-freedom.

16. The method of claim 15 wherein the transport vessel is positioned with respect to the stationary platform such that the centerline of the transport vessel and a reference axis of the interface form a first angle that is within the range of approximately +30 degrees to approximately −30 degrees.

17. The method of claim 16 further comprising moving the first end of the ramp to a coupling position, wherein moving the first end of the ramp substantially aligns the centerline and the reference line such that the first angle is approximately zero degrees.

18. The method of claim 17 wherein moving the first end of the ramp induces rotation of the interface about the first axis.

19. The method of claim 15 further comprising disabling rotation of the interface about the first axis.

20. The method of claim 15 further comprising decoupling the first end of the ramp and the interface when motion of the transport vessel relative to the stationary platform exceeds a threshold.

* * * * *